US007557683B1

(12) United States Patent
Wang

(10) Patent No.: US 7,557,683 B1
(45) Date of Patent: Jul. 7, 2009

(54) SWITCHING DEVICE FOR A TRANSFER SWITCH

(75) Inventor: Shun-Fa Wang, Kaohsiung (TW)

(73) Assignee: Kutai Electronics Industry Co., Ltd., Kaohsiung (TW)

( * ) Notice: Subject to any disclaimer, the term of this patent is extended or adjusted under 35 U.S.C. 154(b) by 0 days.

(21) Appl. No.: 12/290,991

(22) Filed: Nov. 5, 2008

(51) Int. Cl.
*H01H 67/06* (2006.01)
*H01H 9/24* (2006.01)

(52) U.S. Cl. ..... 335/106; 335/114; 335/122; 200/50.32; 200/50.35

(58) Field of Classification Search ..... 335/106–108, 335/114, 121, 122; 200/50.32–50.36
See application file for complete search history.

(56) References Cited

U.S. PATENT DOCUMENTS 4,791,255 A * 12/1988 Eliezer ..... 218/1
5,576,604 A * 11/1996 Kunert et al. ..... 318/135
5,638,948 A * 6/1997 Sharaf et al. ..... 200/401
6,538,223 B1 * 3/2003 Yoshida et al. ..... 200/401
6,815,624 B2 * 11/2004 Schultz ..... 200/50.33

* cited by examiner

*Primary Examiner*—Ramon M Barrera
(74) *Attorney, Agent, or Firm*—William E. Pelton, Esq.; Cooper & Dunham LLP

(57) ABSTRACT

A switching device for a transfer switch has a pivotal body, a solenoid, a resilient pushing device and a main spring. The pivotal body has a pivotal axis, a first recess, a second recess and a connecting axis. The first and second recesses are defined adjacent to each other. The connecting axis is defined between the first and second recesses. The solenoid is connected to the pivotal body with a lever and has a driving shaft with a center line. The main spring has a connecting end being connected to the pivotal body at a point on the connecting axis. The lever has a center line. The connecting end of the main spring connected to the connecting axis is offset to the center line of the lever when the center line of the lever aligns with the center line of the driving shaft.

10 Claims, 8 Drawing Sheets

SWITCHING DEVICE FOR A TRANSFER SWITCH

BACKGROUND OF THF INVENTION

1. Field of the Invention

The present invention relates to a switching device, and more particularly to a switching device for a transfer switch and that can automatically switch to an auxiliary power source when a main power source being cut off.

2. Description of Related Art

A building, such as a manufacturing plant or hospital is always connected to a main power source and an auxiliary power source that provides electrical power to the building when the main power source is cut off. Therefore, a transfer switch is always electrically connected between the main and auxiliary power sources to switch the electrical connection of the building to the power sources.

With reference to FIG. 10, a conventional transfer switch comprises a base (80) and a switching device (90). The base (80) has two contacting tags (81,82) respectively connected electrically to a main power source and an auxiliary power source.

The switching device (90) comprises two solenoids (83), a switching rod (91), an extension arm (92), a pivot (94) and two resilient members (93). The solenoids (83) are mounted on the base (80) and face to each other. Each solenoid (83) has a driving shaft (84) driven by electromagnetic power generated by the solenoid (83) and extends toward the driving shaft (84) of the other solenoid (83). A connecting linkage (85) is mounted between the driving shafts (84) of the solenoids (83) and has an elongated hole (851) defined through the connecting linkage (85).

The switching rod (91) is pivotally connected to the base (80) by the pivot (94) and has a first end, a second end and a middle. The first end is connected to the pivot (94) for pivotally connection with the base (80). The second end is provided with a connector (95) selectively abutting with one of the connecting tags (81,82) on the base (80) and electrically connected to a power system of a building. A sliding rod (911) is mounted on the middle of the switching rod (91) and is slidably held in the elongated hole (851) in the connecting linkage (85). The extension arm (92) is laterally formed and protrudes from the first end of the switching rod (91) and has two ends. The resilient members (93) may be springs and are connected respectively to the ends of the extension arm (92) and the base (80).

With the contact between the connector (95) and the connecting tag (81) connected to the main power source, the electrical power provided by the main power source can be led to the building. When the main power source is cut off, one of the solenoids (83) corresponding to the auxiliary power source is actuated and retracts the driving shaft (84) of the solenoid (83). Consequently, the driving shaft (43) of the other solenoid (83) connected to the main power source will be extended out to make the connecting linkage (85) moving toward the solenoid (83) corresponding to the auxiliary power source. With the movement of the connecting linkage (85), the switching rod (91) is pivoted relative to the base (80) with the resilient force provided by the resilient members (93). Accordingly, the connector (95) on the switching rod (91) is switched to contact with the connecting tag (82) connected to the auxiliary power source. Thus, the building is provided with electrical power by the auxiliary power source.

When the main power source recovers, the switching rod (91) is pivoted in reverse to make the connector (95) contacting with the connecting tag (81) connected to the main power source.

However, the conventional transfer switch comprises two solenoids (83), but the solenoids (83) are at a high cost and take large spaces for arrangement. Therefore, the manufacturing cost for the transfer switch is high.

To overcome the shortcomings, the present invention tends to provide a switching device to mitigate or obviate the aforementioned problems.

SUMMARY OF THE INVENTION

The main objective of the invention is to provide a switching device for a transfer switch and that can automatically switch to an auxiliary power source when a main power source being cut off.

The switching device has a pivotal body, a solenoid, a resilient pushing device and a main spring. The pivotal body has a pivotal axis, a first recess, a second recess and a connecting axis. The pivotal axis is defined as an axis along which the pivotal body is pivotally connected to a base. The first recess is defined in the pivotal body, and the second recess is defined in the pivotal body adjacent to the first recess. The connecting axis is defined between the first and second recesses. The solenoid is connected to the pivotal body with a lever and has a driving shaft with a center line. The resilient pushing device is mounted in the pivotal body. The main spring has a connecting end being connected to the pivotal body at a point on the connecting axis. The lever has a first end, a second end and a center line. The first end is pivotally connected to the driving shaft of the solenoid and has a pivoting center. The second end is provided with a positioning stub selectively held in one of the first and second recesses in the pivotal body and abutting with the resilient pushing device. The positioning stub has a positioning center. The center line is defined between the pivoting center of the first end of the lever and the positioning center of the positioning stub. The connecting end of the main spring connected to the connecting axis of the pivotal body is offset to the center line of the lever when the center line of the lever aligns with the center line of the driving shaft.

Other objects, advantages and novel features of the invention will become more apparent from the following detailed description when taken in conjunction with the accompanying drawings.

DETAILED DESCRIPTION OF PREFERRED EMBODIMENT

Figure 1:
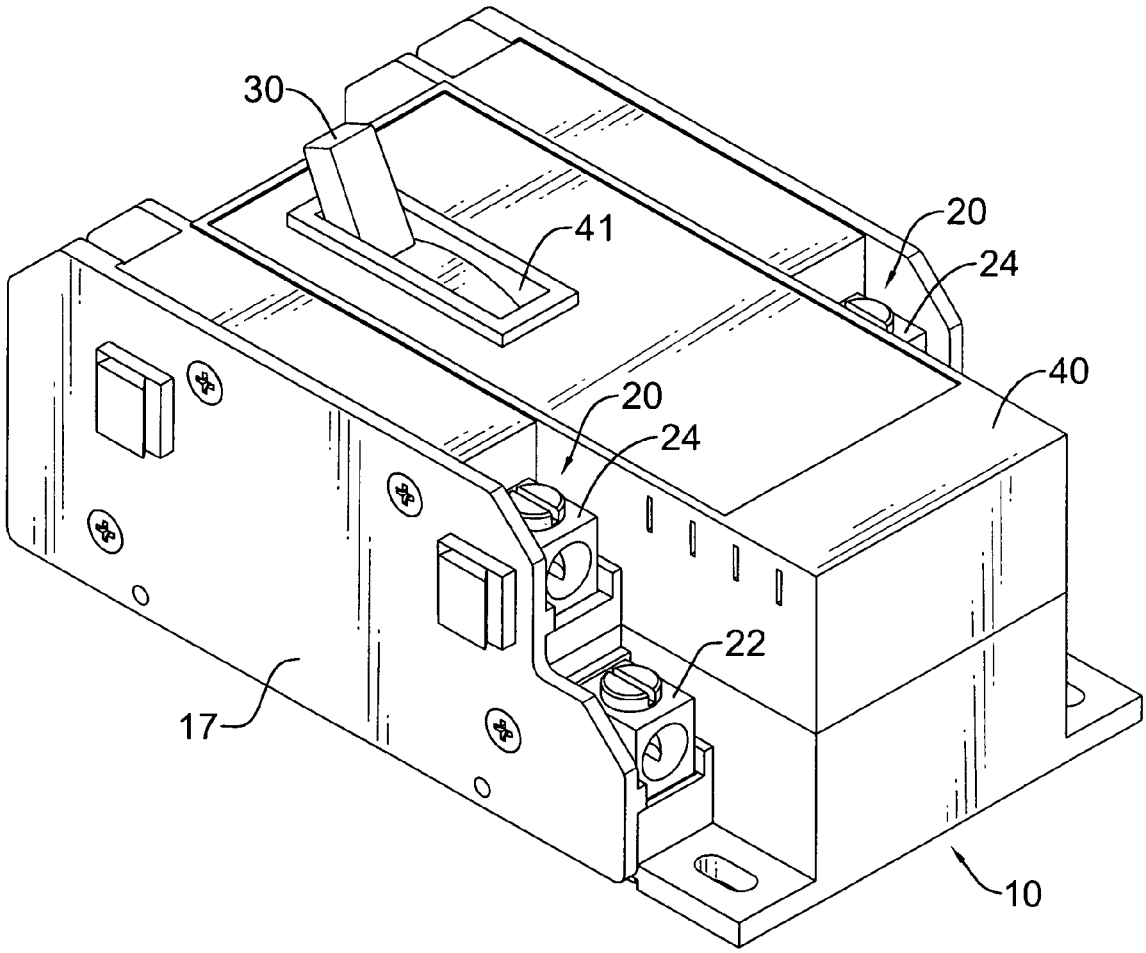
FIG. 1 is a perspective view of a transfer switch with a switching device in accordance with the present invention.
Figure 2:
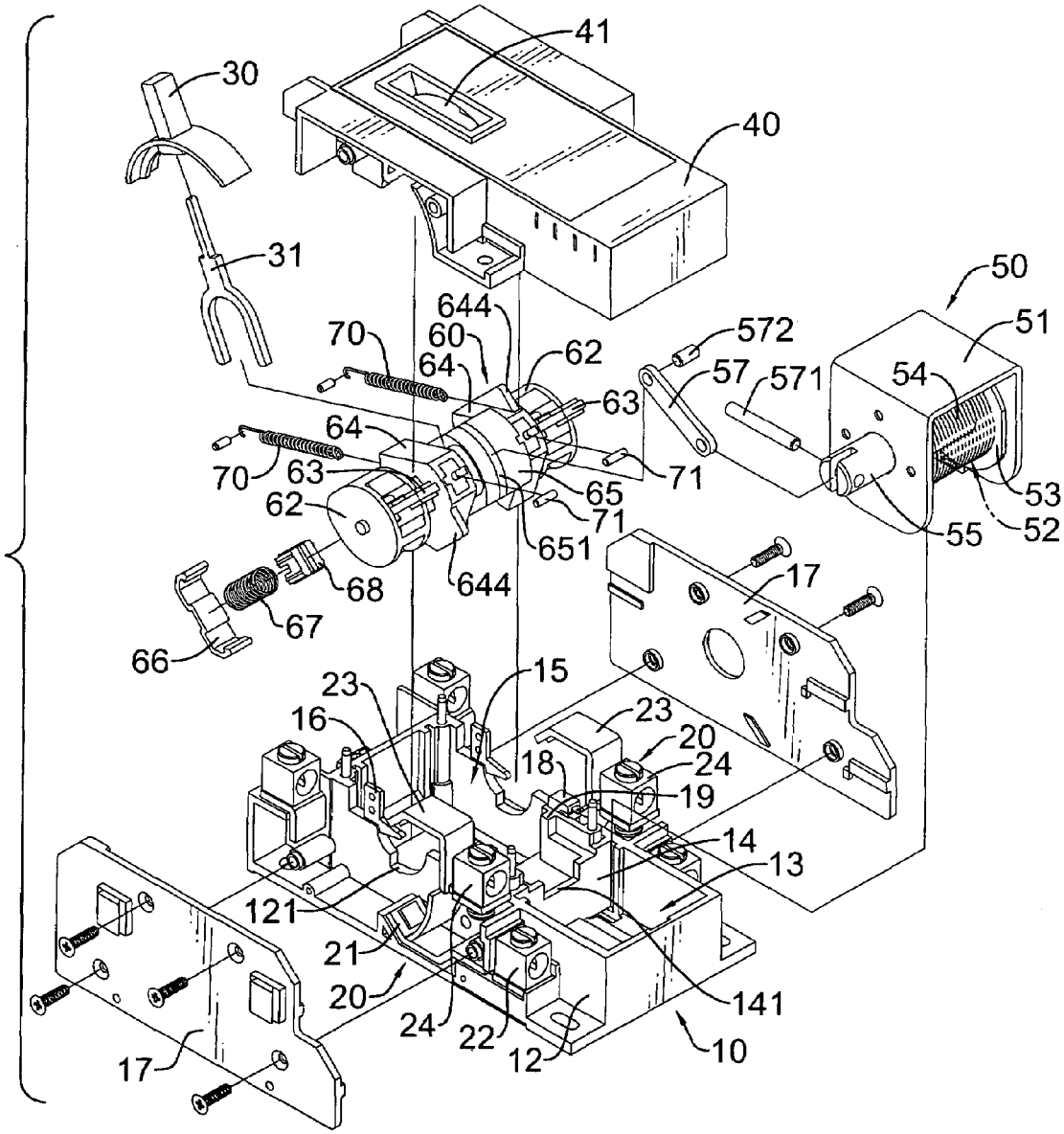
FIG. 2 is an exploded perspective view of the transfer switch with the switching device in FIG. 1.
Figure 3:
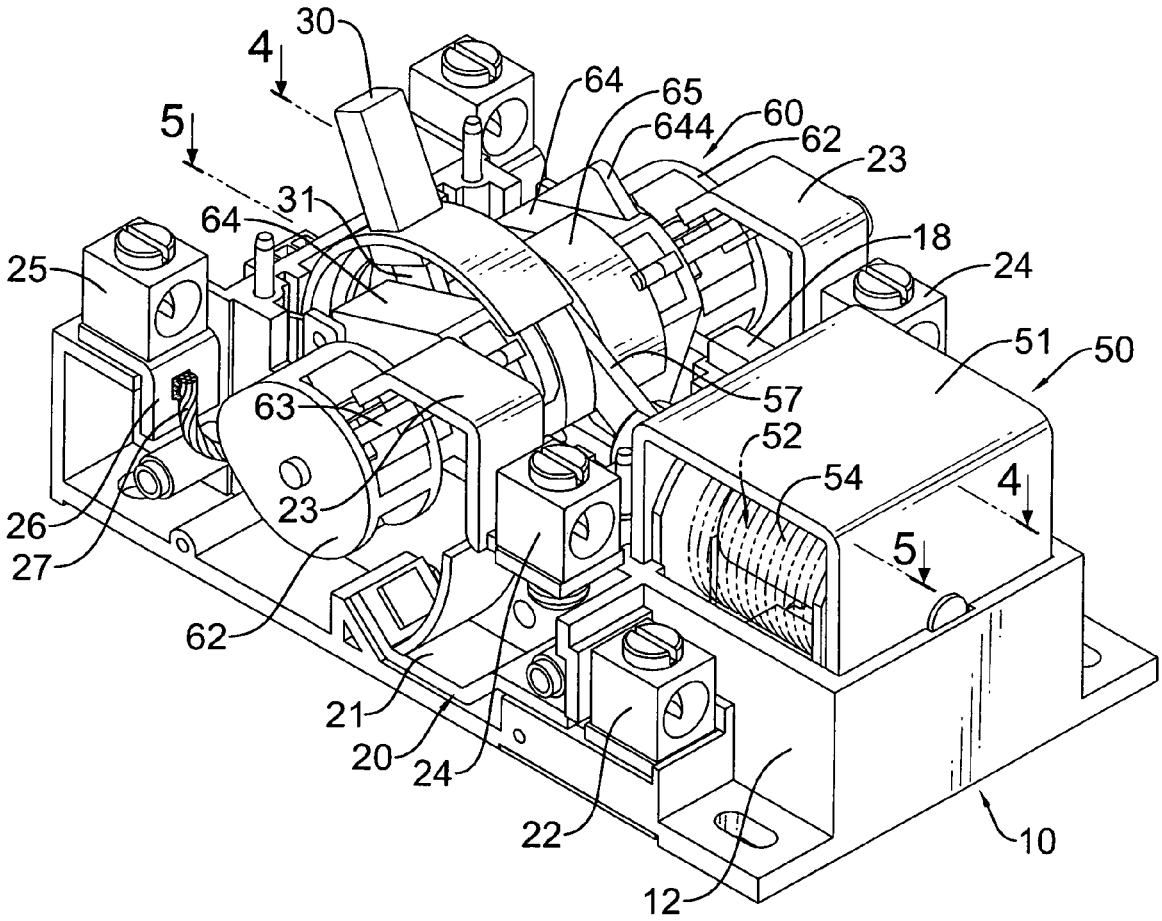
FIG. 3 is a perspective view of the transfer switch in FIG. 1 with a cover being removed.
Figure 4:
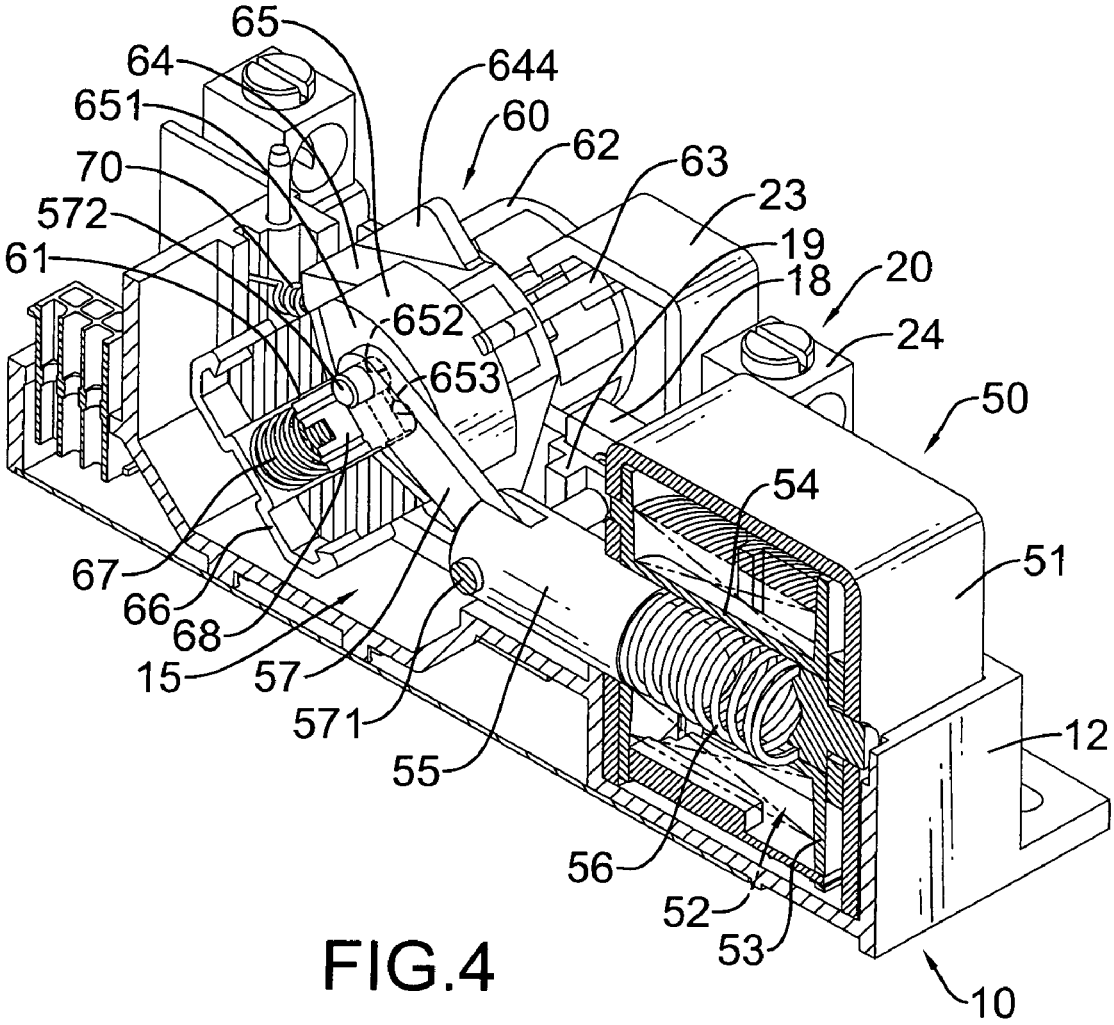
FIG. 4 is a perspective view in partial section of the transfer switch along line 4-4 in FIG. 3.
Figure 5:
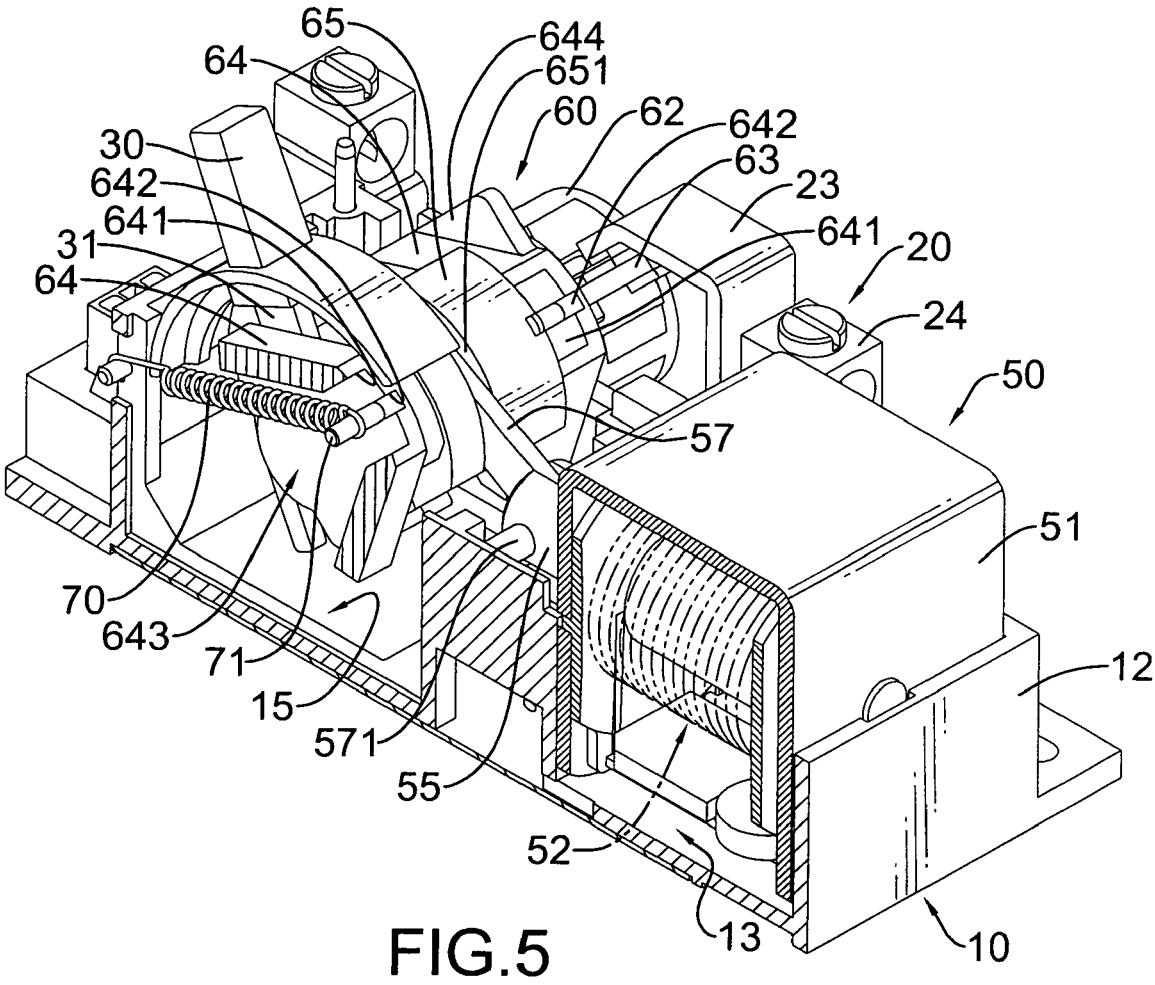
FIG. 5 is another perspective view in partial section of the transfer switch along line 5-5 in FIG. 3.

With reference to FIGS. 1 and 2, a transfer switch comprises a base (10) and a switching device. The base (10) has a bottom panel, two side panels (17), a connection device (20) and a cover (40). The bottom panel has a holding bracket (12) formed on the top of the bottom panel. The holding bracket (12) is hollow and is divided into a solenoid chamber (13) and a pivotal chamber (15) by a baffle wall (14). Two pivotal recesses (121) are defined respectively in two sides of pivotal chamber (15). A stop (19) is formed on and protrudes from the inner surface of the pivotal chamber (15) near the baffle wall (14). A notch (141) is defined in a top of the baffle wall (14) and communicates with the chambers (13,15).

The connection device (20) comprises multiple connecting terminals (22,24), multiple connecting arms (21,23). The terminals (22,24) are mounted on the bottom panel respectively at two sides of the holding bracket (12) and are connected respectively to a main power source and an auxiliary power source. The connecting arms (21,23) are mounted on the bottom panel respectively at two sides of the holding bracket (12) in pairs and are connected respectively to the terminals (22,24). Thus, the connecting arms (21,23) are electrically connected respectively to the main power source and the auxiliary power source by the terminals (22,24). The side panels (17) are attached to the bottom panel and the cover (40) is attached to the side panels (17) to enclose the switching device inside. The cover (40) has a slot (41) defined through the cover (41). A handle (30) is connected to the switching device with a driving fork (31) and extends through the slot (41) in the cover (40) to allow a user to switch the switching device manually by the handle (30).

With further reference to FIGS. 3 to 6, the switching device in accordance with the present invention comprises a pivotal body (60), a solenoid (50), a resilient pushing device and at least one main spring (70). The pivotal body (60) is pivotally mounted on holding bracket (12) in the pivotal chamber (15). In a preferred embodiment, two ends (62) of the pivotal body (60) are respectively held rotatably in pivotal recesses (121) in the holding bracket (12). Two L-shaped boards (16) are mounted respectively on two sides of the pivotal chamber (15) and respectively extend into and partially cover the pivotal recesses (121) to rotatably hold the ends (62) of the pivotal body (60) in the pivotal recesses (121).

The pivotal body (60) has a pivotal axis P3, a first recess (652), a second recess (653), at least one connection segment (64), a driven segment (65), a connecting axis P5 and two connecting tabs (63). The pivotal body (60) is connected to the handle (30) by the driving fork (31) to allow the pivotal body (60) to be pivoted manually.

The pivotal axis P3 is defined as an axis along which the pivotal body (60) is pivotally connected to the base (10).

The first recess (652) and the second recess (653) are formed in the driven segment of the pivotal body (60) and adjacent to each other. In a preferred embodiment, a slot (651) is defined radially in the driven segment (65) of the pivotal body (60) and has an inner surface, and the first and second recesses (652,653) are defined in the inner surface of the slot (651).

The connecting axis P5 is defined between the first and second recesses (652,653) and extends longitudinally through at least one of the connection segment (64), the driven segment (65) and the slot (651).

The contacting tabs (63) are mounted respectively on the ends of the pivotal body (60) and are electrically connected to a power system of a building by a wire (27), a connecting tag (26) and a terminal (25) mounted on the bottom panel of the base (10). The connecting tabs (63) selectively contact respectively with the connecting arms (21,23) to provide electrical power to the power system from either the main or auxiliary power sources.

The solenoid (50) is held in the solenoid chamber (13) in the holding bracket (12), is connected to the pivotal body (60) with a lever (57) and has a housing (51), a coil (52), a coil base (53), a sleeve (54), a driving shaft (55) and a spring (56). The driving shaft (55) extends through the notch (141) in the baffle wall (14) and into the pivotal chamber (15) and corresponds to and is selectively stopped by the stop (19) in the pivotal chamber (13) of the holding bracket (12). The driving shaft (55) has a center line CL. The solenoid may be conventional, so the detail description of the structure of the solenoid is omitted.

The lever (57) has a first end, a second end and a center line. The first end is pivotally connected to the driving shaft (55) of the solenoid with a pivot (571) and has a pivoting center P1. When the pivot (571) abuts against the stop (19), the movement of the driving shaft (55) will be stopped.

The second end is connected to the driven segment (65) of the pivotal body (60) and is provided with a positioning stub (572) selectively held in one of the first and second recesses (652,653) in the pivotal body (60), and the positioning stub (572) has a positioning center P2.

The center line of the lever (57) is defined between the pivoting center P1 and the positioning center P2 of the positioning stub (572).

The resilient pushing device is mounted in the pivotal body (60) and abuts with the positioning stub (572) on the second end of the lever (57). The resilient pushing device comprises a chamber (61), a pusher (68) and a biasing member (67). The chamber (61) is defined radially in the pivotal body (60) and communicates with the slot (651). The pusher (68) is slidably mounted in the chamber (61) and abuts with and pushes against the positioning stub (572) on the lever (57). The biasing member (67) may be a spring, is held in the chamber (61) and abuts with the pusher (68) to provide a force to the pusher (68) to push against the positioning stub (572) on the lever (57). A cap (66) is attached to the pivotal body (60) and closes the chamber (61) to hold the pusher (68) and biasing member (67) in the chamber (61).

The at least one main spring (70), preferably two main springs (70) are connected respectively to two connection segments (64) of the pivotal body (60). Each main spring (70) has a connecting end being connected to pivotal body (60) at a point on the connecting axis P5 and a secured end connected to the base (10) at a point P4. In a preferred embodiment, the line between P3 and P4 is in alignment with the central line CL of the driving shaft (55). In addition, the connecting end of the main spring (70) connected to the connecting axis P5 of the pivotal body (10) is offset to the center line in the lever (57) when the center line of the lever (57) aligns with the center line CL of the driving shaft (55).

To connect the main springs (70) to the connecting axis P5 of the pivotal body (60), two cavities (643) are defined radially in the connection segments (64) of the pivotal body (60), and each cavity (643) has an inner surface with opposite sides. The connecting axis P5 extends longitudinally through the cavities (643). Each cavity (643) has an opening (641) defined in the pivotal body (60) and communicating with the cavity (643). Each cavity (643) has two notches (642) defined respectively in the opposite sides of the inner surface of the cavity (643) adjacent to the opening (641) and aligned and coaxial with the connecting axis P5 of the pivotal body (60).

A connecting rod (71) is located at the connecting axis P5 of the pivotal body (60) and has two ends held respectively in the notches (642). The connecting end of each main spring (70) extends into a corresponding cavity (643) and is connected to the corresponding connecting rod (71).

Figure 6:
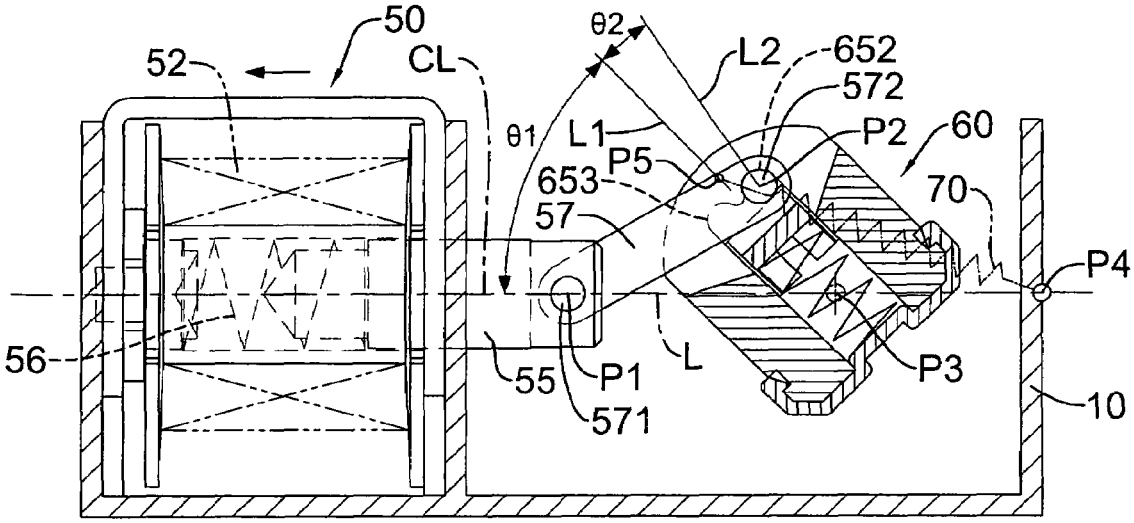
FIGS. 6 to 9 are operational side views in partial section of the switching device in FIG. 1.

In operation, with reference to FIGS. 2 and 6 to 9, the connecting tabs (63) on the pivotal body (60) originally contact respectively with the connecting arms (23) that are connected to the main power source via the terminals (24). At this time, the positioning stub (572) on the lever (57) is held and engages the first recess (652) in the pivotal body (60) as shown in FIG. 6. A line L1 between a point on the pivotal axis P3 and a point on the connecting axis P5 has an angle θ1 relative to a line L between the pivotal axis P3 and the pivoting center P1 of the lever (57). Wherein, the line L may be in alignment with the center line of the driving shaft (55). A line L2 between the point on the pivotal axis P3 and the positioning center P2 of the positioning stub (572) on the lever (57) has an angle θ2 relative to the line L1 between the points on the pivotal axis P3 and connecting axis P5.

Figure 7:
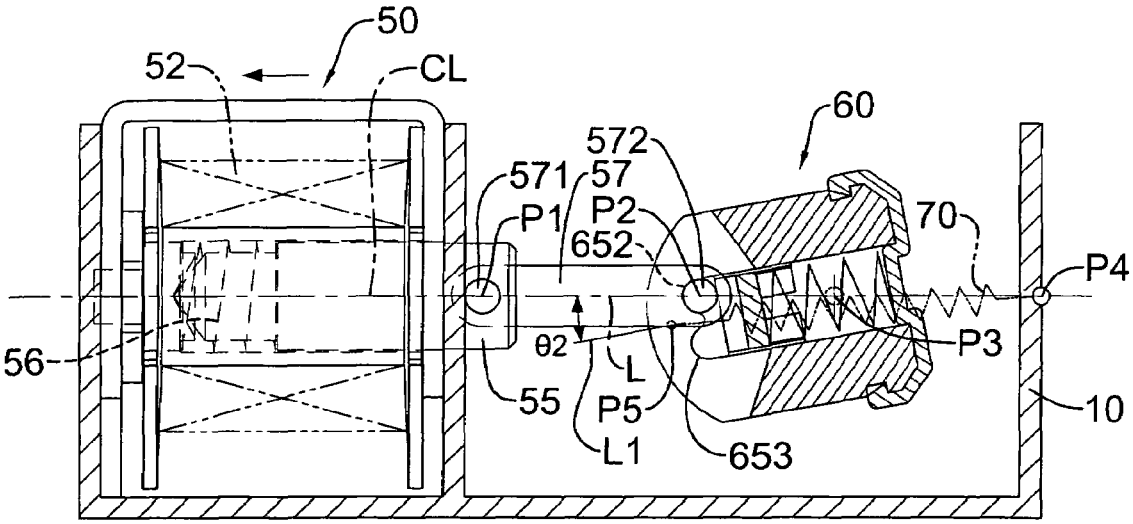

When the main power is cut off, the solenoid (50) is actuated to retract the driving shaft (55) into the housing (51) of the solenoid (50) as shown in FIG. 7. Thus, the pivotal body (60) is pivoted to make the center line of the lever (57) and the line L2 aligned with each other and in alignment with the line L and the center line CL of the driving shaft (55). At this time, the line L1 has an angle θ2 relative to the lines L and CL, and the connecting tabs (63) leave the position where contact with the connecting arms (23) connected to the main power source.

Figure 8:
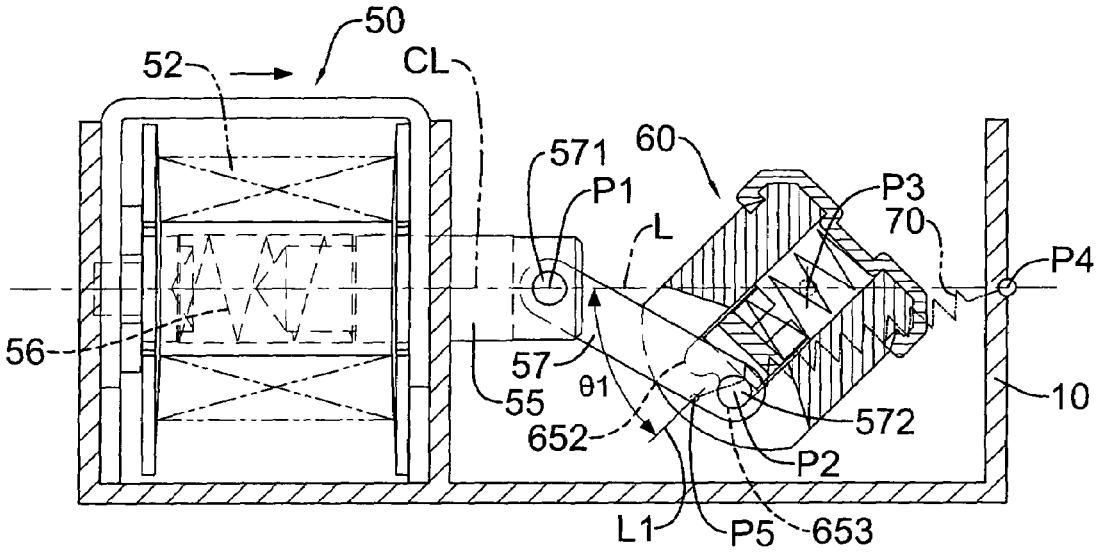

Then, the spring (56) pushes the driving shaft (55) out from the housing (51) of the solenoid (50) to further pivot the pivotal body (60) downward by the lever (57). During the downward pivotal rotation of the pivotal body (60), the positioning stub (572) on the second end of the lever (57) will disengage from the first recess (652) and pushes the pusher (68) of the resilient pushing device to slide relative to the chamber (61). When the pivotal body (60) rotates to a position where the line L1 between points on the pivotal axis P3 and connecting axis P5 has an angle θ1 relative to the line L, the positioning stub (572) enters and engages the second recess (653) in the pivotal body (60) as shown in FIG. 8. At this time, the connecting tabs (63) on the pivotal body (60) contact with the connecting arms (21) that are connected to the auxiliary power source. Accordingly, the building can be provided with electrical power from the auxiliary power source.

Figure 9:
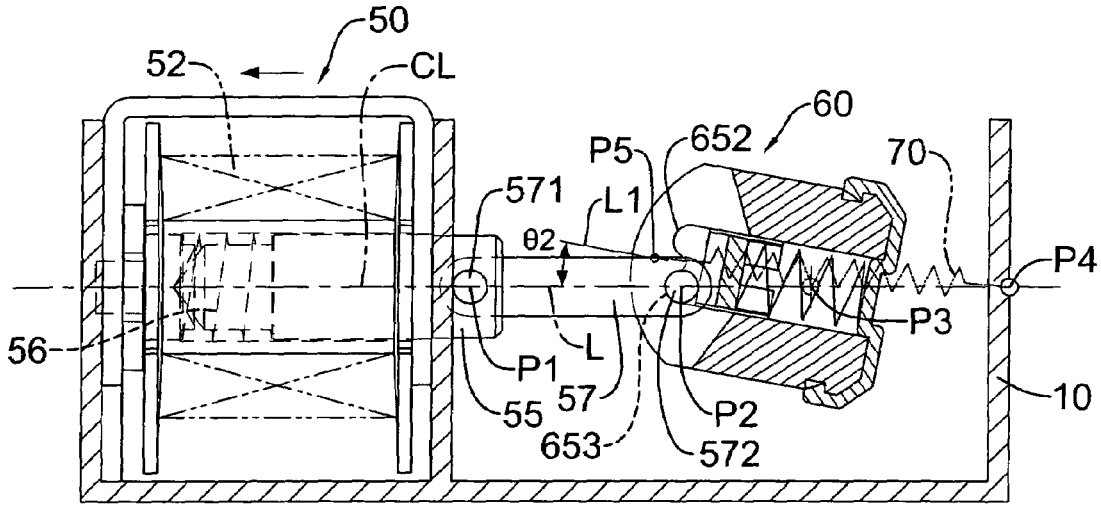
Figure 10:
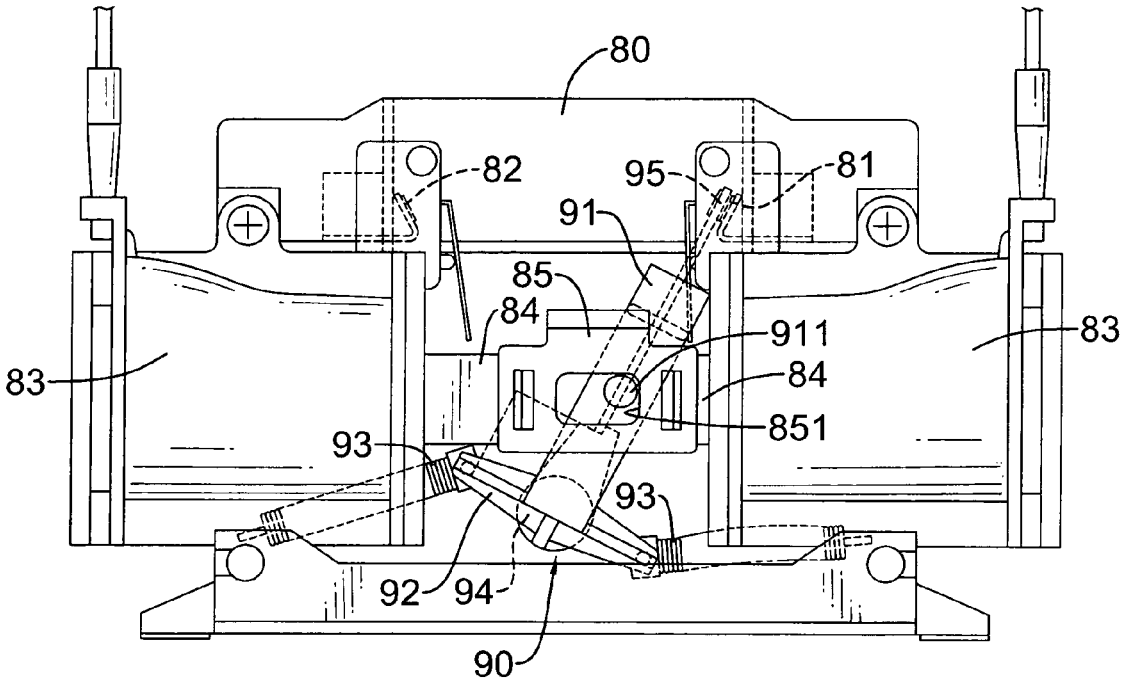
FIG.10 PRIOR ART
FIG. 10 is a side view of a conventional transfer switch with a switching device in accordance with the prior art.

When the main power source is recovered, the solenoid (50) is actuated to pivot the pivotal body (60) by the retraction of the driving shaft (55) with the lever (57). When the center line of the lever (57) and the line L2 are in alignment with the center line CL of the driving shaft (55) and the line L, the line L1 has an angle θ2 relative to the line L and the center line CL of the driving shaft (55) as shown in FIG. 9. At this time, the connecting tabs (63) leave the position where contact with the connecting arms (21) connected to the auxiliary power source. With the extension of the driving shaft (55), the pivotal body (60) is further pivoted upward to a position where the line L1 has an angle θ1 relative to the line L, the line L2 has an angle θ2 relative to the line L1 and the positioning stub (572) is held and engages the first recess (652) as shown in FIG. 6. Accordingly, the building is provided with electrical power by the main power source.

With such a switching device, only one solenoid (50) is needed, and the power system of a building can be automatically switched to connect the main power source or the auxiliary power source by the transfer switch. Therefore, the manufacturing cost and arranging space for a transfer switch can be lowered down. Furthermore, the switching device can be controlled by manually pushing or pulling the handle (30) and is versatile in use.

In addition, two limiting switches (18) are mounted on the holding bracket (12) at different heights, and two limiting wings (644) are formed and protrude from the pivotal body (60) and correspond respectively to the limiting switches (18). With the abutment of one of the limiting wings (644) and a corresponding limiting switch (18), the pivoting angle of the pivotal body (60) is limited at a predetermined range. Additionally, a signal will be sent to a lamp device to show the connection condition of the switching device with the main power source or the auxiliary power source.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A switching device for a transfer switch comprising:

a pivotal body having a pivotal axis being defined as an axis along which the pivotal body is pivotally connected to a base;

a first recess defined in the pivotal body;

a second recess defined in the pivotal body adjacent to the first recess; and a connecting axis defined between the first and second recesses;

a solenoid connected to the pivotal body with a lever and having a driving shaft with a center line;

a resilient pushing device mounted in the pivotal body; and a main spring having a connecting end being connected to the pivotal body at a point on the connecting axis, wherein the lever has a first end pivotally connected to the driving shaft of the solenoid and having a pivoting center;

a second end provided with a positioning stub selectively held in one of the first and second recesses in the pivotal body and abutting with the resilient pushing device, and the positioning stub having a positioning center; and a center line defined between the pivoting center of the first end of the lever and the positioning center of the positioning stub; and the connecting end of the main spring connected to the connecting axis of the pivotal body is offset to the center line of the lever when the center line of the lever aligns with the center line of the driving shaft.

2. The switching device as claimed in claim 1, wherein the pivotal body further has a slot with an inner surface radially defined in the pivotal body; and the first and second recesses are defined in the inner surface of the slot.

3. The switching device as claimed in claim 2, wherein the pivotal body has two ends and two contacting tabs mounted respectively on the ends of the pivotal body.

4. The switching device as claimed in claim 3, wherein the pivotal body further has a cavity defined radially in the pivotal body and having an inner surface with opposite sides, wherein the connecting axis of the pivotal body extends longitudinally through the cavity;

an opening defined in the pivotal body and communicating with the cavity;

two notches defined respectively in the opposite sides of the inner surface of the cavity adjacent to the opening and aligned and coaxial with the connecting axis of the pivotal body; and a connecting rod located at the connecting axis of the pivotal body and having two ends held respectively in the notches; and the end of the main spring is connected to the connecting rod.

5. The switching device as claimed in claim 4, wherein the resilient pushing device comprises a chamber defined radially in the pivotal body and communicating with the slot;

a pusher slidably mounted in the chamber and abutting with and pushing against the positioning stub on the lever; and a biasing member held in the chamber and abutting with the pusher to provide a force to the pusher to push against the positioning stub on the lever.

6. The switching device as claimed in claim 5, wherein the main spring has a secured end be secured at a point; and a line defined between the secured end of the main spring between a point of the pivotal axis of the pivotal body is in alignment with the central line of the driving shaft.

7. The switching device as claimed in claim 1, wherein the pivotal body has two ends and two contacting tabs mounted respectively on the ends of the pivotal body.

8. The switching device as claimed in claim 1, wherein the pivotal body further has a cavity defined radially in the pivotal body and having an inner surface with opposite sides, wherein the connecting axis of the pivotal body extends longitudinally through the cavity;

an opening defined in the pivotal body and communicating with the cavity;

two notches defined respectively in the opposite sides of the inner surface of the cavity adjacent to the opening and aligned and coaxial with the connecting axis of the pivotal body; and a connecting rod located at the connecting axis of the pivotal body and having two ends held respectively in the notches; and the end of the main spring is connected to the connecting rod.

9. The switching device as claimed in claim 1, wherein the resilient pushing device comprises a chamber defined radially in the pivotal body and communicating with the slot;

a pusher slidably mounted in the chamber and abutting with and pushing against the positioning stub on the lever; and a biasing member held in the chamber and abutting with the pusher to provide a force to the pusher to push against the positioning stub on the lever.

10. The switching device as claimed in claim 1, wherein the main spring has a secured end be secured at a point; and a line defined between the secured end of the main spring between a point of the pivotal axis of the pivotal body is in alignment with the central line of the driving shaft.

* * * * *